US007425059B2

(12) United States Patent
Kudo et al.

(10) Patent No.: US 7,425,059 B2
(45) Date of Patent: Sep. 16, 2008

(54) INK CONTAINER, INKJET PRINTING HEAD, AND INKJET PRINTING APPARATUS

(75) Inventors: Kiyomitsu Kudo, Tokyo (JP); Akira Tsujimoto, Kanagawa-ken (JP); Satoshi Kudo, Kanagawa-ken (JP); Toru Suzuki, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 208 days.

(21) Appl. No.: 10/566,173

(22) PCT Filed: Apr. 19, 2005

(86) PCT No.: PCT/JP2005/007757

§ 371 (c)(1),
(2), (4) Date: Jan. 27, 2006

(87) PCT Pub. No.: WO2005/102712

PCT Pub. Date: Nov. 3, 2005

(65) Prior Publication Data

US 2006/0284944 A1 Dec. 21, 2006

(30) Foreign Application Priority Data

Apr. 19, 2004 (JP) ..... 2004-123119

(51) Int. Cl.
*B41J 2/175* (2006.01)

(52) U.S. Cl. ..... 347/85; 347/22; 347/86; 347/87; 400/59; 400/582

(58) Field of Classification Search ..... None
See application file for complete search history.

(56) References Cited

U.S. PATENT DOCUMENTS 4,855,762 A 8/1989 Suzuki ..... 346/140 R
5,523,780 A 6/1996 Hirosawa et al. ..... 347/86
6,264,315 B1 * 7/2001 Nozawa et al. ..... 347/86
6,540,321 B1 * 4/2003 Hirano et al. ..... 347/22
6,840,610 B2 1/2005 Taniguchi et al. ..... 347/86
2005/0231572 A1 10/2005 Suzuki et al. ..... 347/87

(Continued)

FOREIGN PATENT DOCUMENTS

EP 1057464 12/2000

(Continued)

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

The present invention solves problems attributable to color mixing occurring at a region where an ink container containing three or more different inks and an inkjet printing head are connected as a result of repetition of connection and disconnection of the components. An ink cartridge has a joint section which is connected to a printing head unit when the inks are supplied to the printing head unit. The printing head unit performs printing by ejecting the cyan, magenta, and yellow inks. At the joint section, a supplying part for the cyan ink, a supplying part for the magenta ink, and a supplying part for the yellow ink are arranged in the order listed. The interval between the yellow ink supplying part and the magenta ink supplying part is greater than the interval between the cyan ink supplying part and the magenta ink supplying part.

9 Claims, 12 Drawing Sheets

U.S. PATENT DOCUMENTS

| | | | | |
|---|---|---|---|---|
| 2005/0270344 | A1 | 12/2005 | Tsujimoto et al. | 347/86 |
| 2006/0232647 | A1 | 10/2006 | Suzuki et al. | 347/85 |

FOREIGN PATENT DOCUMENTS

| | | | |
|---|---|---|---|
| EP | 1057644 | A2 * | 12/2000 |
| EP | 1375155 | | 1/2004 |
| JP | 6-8463 | | 1/1994 |
| JP | 7-81091 | | 3/1995 |
| WO | 2004/096559 | | 11/2004 |

* cited by examiner

INK CONTAINER, INKJET PRINTING HEAD, AND INKJET PRINTING APPARATUS

TECHNICAL FIELD

The present invention relates to an ink container, an inkjet printing head, and an inkjet printing apparatus used for inkjet printing. More particularly, the invention relates to an ink container for containing three or more types of inks, an inkjet printing head capable of ejecting ink supplied from such ink container, and an inkjet printing apparatus for performing printing on a printing medium using such ink container and inkjet printing head.

DESCRIPTION OF THE RELATED ART

Inkjet printing apparatus that are recently spreading include those which print a color image using a plurality of inkjet printing heads for ejecting inks in different colors. Referring to the mode of implementation of the plurality of inkjet printing heads, they may be implemented not only as individual units independent of each other but also as a printing head unit formed by integrating them.

In general, printing of a color image involves three color inks of yellow (Y), magenta (M), and cyan (C), or four color inks of these three colors plus black (B). Printing is performed using an inkjet printing head capable of ejecting those inks. As a result of the use of inks in a greater number of colors, an ink container for supplying inks to the inkjet printing head are configured to contain inks in a plurality of colors. Some of such ink container is in the form of an ink cartridge which can be attached and detached to and from the inkjet printing head. Inkjet printing apparatus in practical use include those which can print images with image quality on the level of high definition photographs using inks in light magenta (LM) and light cyan (LC) in addition to inks in the above-mentioned four colors, i.e., using six colors in total.

The ink cartridge as ink container can be directly or indirectly attached and detached to and from the inkjet printing head. When the ink in the ink cartridge runs out, the ink can be continuously supplied to the inkjet printing head by replacing the ink cartridge with a new one. In the region where the inkjet printing head and the ink cartridge are connected, a receiving part for receiving the ink is provided at the inkjet printing head, and a supplying part for supplying the ink is provided at the ink cartridge.

JP-A-6-8463 discloses an example of a configuration of a connecting section for connecting an inkjet printing head and an ink cartridge in an inkjet printing apparatus for printing color images as described above. The structure of the connecting section will now be described with reference to FIGS. 11 and 12.

An ink cartridge 500 contains inks of three colors, and three ink bags 511 for containing the color inks are provided in a container main body 510 of the cartridge. The ink cartridge 500 has three ink supplying parts 520 in total which are associated with the inks of the respective colors to supply the inks of three colors to an inkjet printing head (not shown). The ink supplying parts 520 include an ink supply hole 521 which is formed at the container main body 510 and a coupling member 522 which is located in the ink supply hole 521. The coupling member 522 is secured at an opening of the ink bag 511. The coupling member 522 is constituted by an elastic member such as a rubber and is formed with a slit in a central part thereof.

The inkjet printing head has ink ejecting parts corresponding to the color ink respectively and an ink receiving part 550 for receiving the inks from the ink cartridge 500. The ink receiving part 550 has three ink supply pipes 551 in total which are connected to the ink ejecting parts respectively and a pipe securing member 552 for holding the ink supply pipes 551. The three ink supply holes 521 of the ink cartridge 500 are provided at predetermined intervals, and the pipe securing member 552 holds the three ink supply pipes 551 at intervals equal to those of the ink supply holes 521.

In such a configuration, the inkjet printing head and the ink cartridge 500 are connected such that the ink supply pipes 551 are inserted into the coupling member 522 through the respective ink supply holes 521. As a result, the inks in the ink bags 511 can be supplied to the ink ejecting parts of the inkjet printing head through the ink supply pipes 551.

Ink supplying methods for inkjet printing apparatus include the so-called pit-in supply method. According to the pit-in supply method, for example, an ink cartridge is detachably attached to the main body of an inkjet printing apparatus, and a sub-tank having a capacity smaller than that of the ink cartridge is provided at the inkjet printing head separately from the ink cartridge. The ink cartridge and the sub-tank at the inkjet printing head are connected to supply an ink from the ink cartridge to the sub-tank as occasions demand. An ink receiving part that is in communication with the interior of the sub-tank is provided at the inkjet printing head, and an ink supplying part is provided at the ink cartridge. The ink receiving part of the inkjet printing head and the ink supplying part of the ink cartridge are connected to fill the sub-tank with the ink from the ink cartridge based on the result of detection of the amount of ink remaining in the sub-tank.

The inkjet printing head is mounted on a carriage which can be moved in a main scanning direction. When the sub-tank is filled with the ink from the ink cartridge, the carriage carrying the inkjet printing head is moved to a predetermined position to connect the ink receiving part of the inkjet printing head and the ink supplying part of the ink cartridge. No printing operation can be performed when the ink is charged in such a way because the inkjet printing head is fixed at the predetermined position along with the carriage. The ink receiving part of the inkjet printing head and the ink supplying part of the ink cartridge are disconnected from each other when a printing operation is performed.

Such an inkjet printing apparatus prints an image on a printing medium by alternately repeating an operation of ejecting inks from the inkjet printing head while moving the head in the main scanning direction with the carriage and an operation of conveying the printing medium by a predetermined amount in a direction across the main scanning direction. Such a printing operation is similar to that in serial scan type inkjet printing apparatus in general.

As thus described, the sub-tank having the small capacity is provided on the inkjet printing head mounted on the carriage, and inks are supplied to the sub-tank from the ink cartridge provided at the main body of the inkjet printing apparatus. Thus, the capacity of the sub-tank can be made small, and the carriage carrying the inkjet printing head can be made compact. As a result, mechanisms in a carriage driving section can be also made small, and the inkjet printing apparatus as a whole can consequently be made small-sized.

The connecting section disclosed in JP-A-6-8463 is based on an assumption that the ink cartridge and the inkjet printing head are to be kept connected until the inks in the cartridge are used up.

According to the pit-in supply method, connection and disconnection of the ink supplying part of the ink cartridge and the ink supplying part of the inkjet printing head is repeated each time inks are supplied from the ink cartridge to the sub-tank. Therefore, according to the pit-in supply method, the inkjet printing head on the carriage is repeatedly connected to the same ink cartridge a plurality of times. Especially, in the case of an ink cartridge having a large capacity, the supply of inks from the ink cartridge to the sub-tank of the inkjet printing head may be repeated several tens times or several hundred times.

As thus described, according to the pin-in supply method, connection and disconnection of the ink cartridge and the inkjet printing head is repeated a great number of times. Therefore, when the accuracy of alignment between the ink supplying part of the ink cartridge and the ink receiving part of the inkjet printing head is low, an extra amount of ink can remain in the ink supplying part of the ink cartridge. The residual ink accumulates in the ink supplying part of the ink cartridge as a result of the repetition of connection and disconnection between the ink cartridge and the inkjet printing head. When the accumulation of the residual ink proceeds, the ink can spread even in the neighborhood of the ink supplying part.

When inks of a plurality of colors are used in the inkjet printing head, the ink cartridge has a plurality of ink supplying parts which correspond to the inks of the plurality of colors. In such a case wherein the ink cartridge has the plurality of ink supplying parts as thus described, when the accumulation of residual ink proceeds in each of the ink supplying parts, the residual inks in different colors can spread in the neighborhood of the ink supplying parts which are adjacent to each other and can mix with each other to cause color mixing.

The color inks which have mixed with each other in the neighborhood of the ink supplying parts can be supplied to the inkjet printing head when the ink cartridge and the inkjet printing head are connected next time. When the mixed color ink is supplied to the inkjet printing head, it can change the hues of inks ejected from the inkjet printing head to degrade image quality. Among inks of three colors, i.e., yellow (Y), magenta (M), and cyan (C), the ink of yellow (Y) is particularly vulnerable to color mixing, and a color change of this color is significantly remarkable on a printed image. Once color mixing occurs, a recovery operation may be performed by evacuating the inks in the inkjet printing head by force. However, a great mount of ink must be evacuated to restore the hues of the inks ejected from the inkjet printing head, which results in wasteful consumption of the inks accordingly.

DISCLOSURE OF THE INVENTION

It is an object of the present invention to provide an ink container, an inkjet printing head, and an inkjet printing apparatus in a small size while suppressing the influence of color mixing between inks which can occur at a region where the ink container and the inkjet printing head are connected and disconnected when such connection and disconnection is repeated.

In the first aspect of the present invention, there is provided an ink container connectable and disconnectable to and from an ink supply path, comprising:

a plurality of ink containing parts for containing three or more different inks; and a plurality of supplying parts which can be connected and disconnected to and from the ink supply path and which can supply plural types of ink contained in the plurality of ink containing parts, wherein the plurality of supplying parts include a specific supplying part for supplying the ink which undergoes the most significant color change attributable to color mixing of the inks;

the plurality of supplying parts are disposed at respective intervals; and the interval between the specific supplying part and another of the supplying parts adjacent thereto is greater than the intervals between other supplying parts excluding the specific supplying part.

In the second aspect of the present invention, there is provided an inkjet printing head connectable and disconnectable to and from an ink container, comprising:

a plurality of ink ejecting parts capable of ejecting three or more different inks; and a plurality of receiving parts which can be connected and disconnected to and from the ink container and which can receive the plural types of ink ejected by the plurality of ink ejecting parts from the ink container, wherein the plurality of receiving parts include a specific receiving part for receiving the ink which undergoes the most significant color change attributable to color mixing of the inks;

the plurality of receiving parts are disposed at respective intervals; and the interval between the specific receiving part and another of the receiving parts adjacent thereto is greater than the intervals between other receiving parts excluding the specific receiving part of interest.

In the third aspect of the present invention, there is provided an inkjet printing apparatus for performing printing on a printing medium using an inkjet printing head capable of ejecting an ink supplied from an ink container, comprising a mounting section for mounting an ink container according to the first aspect of the present invention and an inkjet printing head according to the second aspect of the present invention such that they can be connected and disconnected to and from each other.

In the ink container of the present invention, the plurality of supplying parts are disposed at respective intervals, and attention is paid to the supplying part for supplying the ink which undergoes the most significant color change attributable to color mixing of the inks among the plurality of supplying parts. The interval between the supplying part of interest (specific supply part) and another supplying part adjacent to the specific supplying part is made greater than the intervals between the other supplying parts. It is therefore possible to reduce the risk of color mixing for the ink which undergoes the most significant color change attributable to color mixing of the inks. In addition, since only the interval between some of the supplying parts is made great, it is possible to minimize the resultant increase in the size of the region where the supplying parts are disposed.

In the inkjet printing head of the present invention, the plurality of receiving parts are disposed at respective intervals, and attention is paid to the receiving part for receiving the ink which undergoes the most significant color change attributable to color mixing of the inks among the plurality of receiving parts. The interval between the receiving part of interest (specific receiving part) and another receiving part adjacent to the specific receiving part is made greater than the intervals between the other receiving parts. It is therefore possible to reduce the risk of color mixing for the ink which undergoes the most significant color change attributable to color mixing of the inks. In addition, since only the interval between some of the receiving parts is made great, it is possible to minimize the resultant increase in the size of the region where the receiving parts are disposed.

In an inkjet printing apparatus according to the present invention, the use of such an ink container and inkjet printing head reduces the risk of color mixing for the ink which is most vulnerable to color mixing of inks. It is possible to minimize the increase in the size of the region where the ink container and the inkjet printing head are connected.

As thus described, according to the present invention, since the influence of color mixing can be suppressed for an ink which undergoes the most significant color change attributable color mixing of inks, images of high quality can be printed by maintaining stable ink colors. The structure for suppressing color mixing of inks is quite simple, and the structure results in a minimum increase in the size of a region where an ink container and an inkjet printing head are connected. It is therefore possible to suppress an increase in the size of an ink container, an inkjet printing head, and an inkjet printing apparatus.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Now the embodiments of the present invention will be described with reference to the accompanying drawings.

Figure 1A:
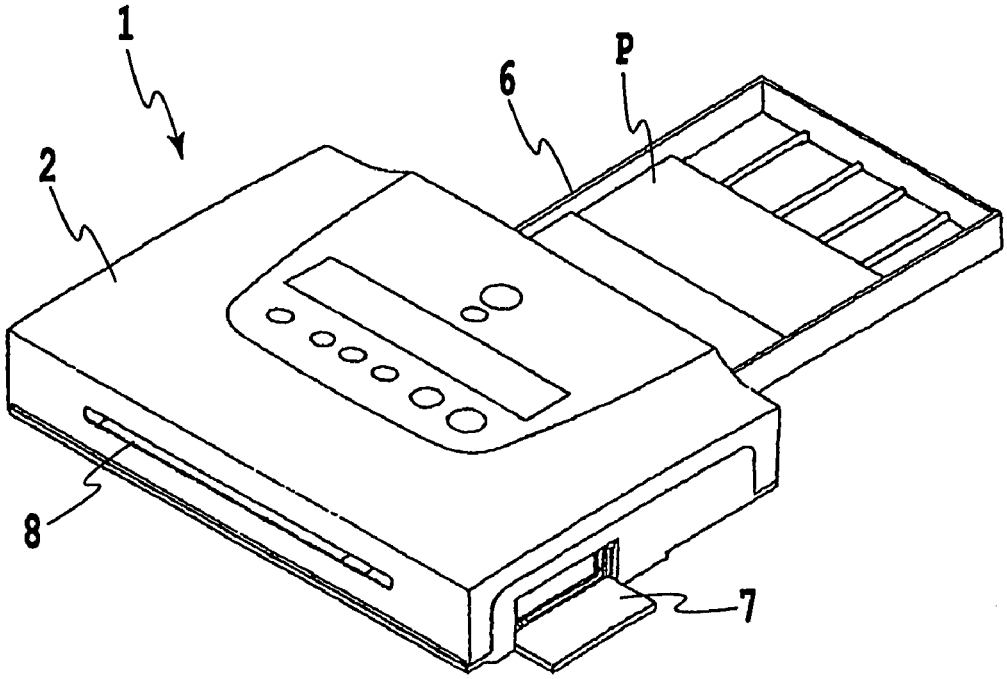
FIG. 1A is a perspective view of an inkjet printing apparatus in an embodiment of the present invention.
Figure 1B:
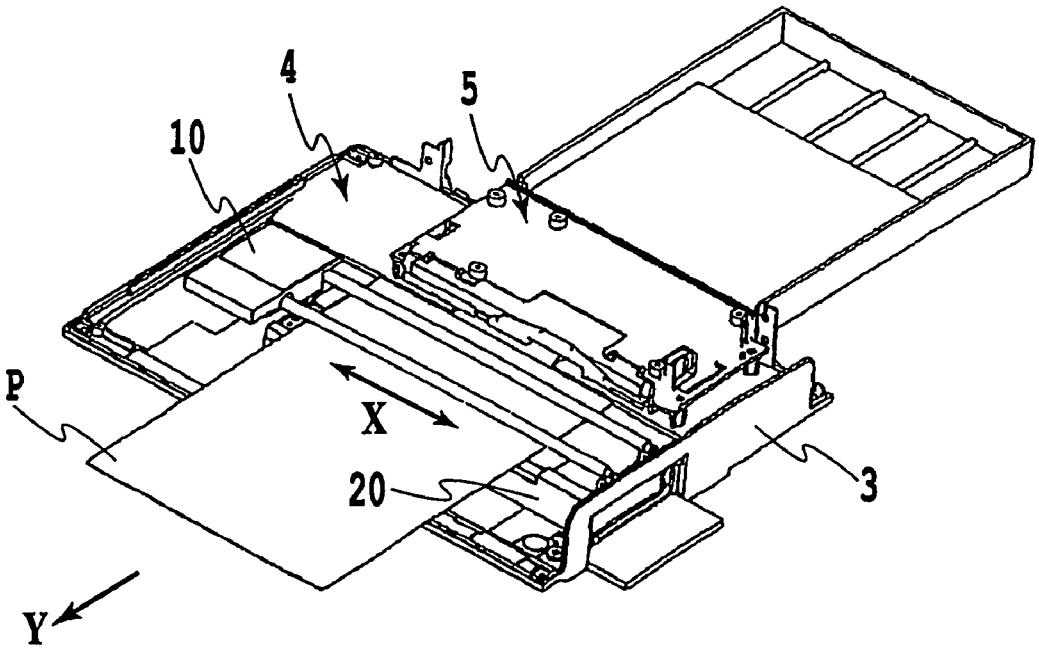
FIG. 1B is a perspective view of the inkjet printing apparatus shown with its top cover removed.

FIG. 1A is an external perspective view of an inkjet printing apparatus 1 in an embodiment of the present invention, and FIG. 1B is a perspective view of the inkjet printing apparatus shown with a top cover of the same removed.

The inkjet printing apparatus 1 of the present embodiment has a printing mechanism section 4, a sheet feeding mechanism section 5, and a sheet supply cassette 6. The printing mechanism section 4 performs a printing operation, and the sheet feeding mechanism section 5 conveys a printing sheet P such as paper or a resin film to the printing mechanism section 4. The sheet supply cassette 6 is removably provided at the sheet feeding mechanism section 5, and the printing sheet P to be supplied to the sheet feeding mechanism section 5 is placed in the cassette 6. The printing mechanism section 4 and the sheet feeding mechanism section 5 are covered by a top case 2 and a bottom case 3 which constitute an outer casing. Each of the top case 2 and the bottom case 3 may be constituted by a single part, and it may alternatively be constituted by a combination of a plurality of parts. A discharging hole 8 for discharging a printing sheet P on which printing has been performed is provided on a front side of the top case 2.

The printing mechanism section 4 has a printing head unit 10, various rollers (not shown), and a head recovery mechanism (not shown). The printing head unit 10 is supported on a guide shaft such that it can be moved back and forth in a main scanning direction that is indicated by the arrow X. The various rollers (not shown) convey a printing sheet P fed from the sheet feeding mechanism section 5 in a sub-scanning direction indicated by the arrow Y extending across the main scanning direction. The head recovery mechanism (not shown) performs a recovery operation which will be described later to maintain preferable ink ejecting characteristics of the printing head unit 10.

The printing head unit 10 ejects inks of three colors (which are specifically inks of yellow, magenta, and cyan) based on an ejection signal, which allows a full-color image to be printed on the printing sheet P. The printing head unit 10 has three ink ejecting parts (not shown) corresponding to the inks of the respective colors and three sub-tanks (not shown) containing the inks to be supplied to the ink ejecting parts. The ink ejecting parts have a plurality of nozzles for ejecting the inks, and an energy-generating element is provided at each of the nozzles to generate energy for ejecting the ink. Elements such as piezoelectric elements utilizing an electromechanical transducer or elements utilizing an electrothermal transducer having a heating resistor may be used as the energy-generating elements. When electrothermal transducers are used, ink droplets can be ejected from ejection ports on the tips of the nozzles utilizing bubbling energy that is generated when bubbles are formed by heating the inks.

A home position is set at one end of the range of the reciprocation of the printing head unit 10. Referring to the position for disposal of the head recovery mechanism, the mechanism is set in a position in which it faces the printing head unit 10 when the printing head unit 10 is in the home position. The head recovery mechanism performs a recovery operation to maintain a preferable ink ejecting condition of the printing head unit 10. For this purpose, the head recovery mechanism has a cap for capping the ink ejecting parts, a wiping member for wiping surfaces of the ink ejecting parts where the nozzles are provided (surfaces where the ejection ports are formed), and a suction pump for evacuating inks from the nozzles by force.

The inkjet printing apparatus 1 performs printing on a printing sheet P as described below.

First, the sheet feeding mechanism section 5 operates to deliver printing sheets P placed in the sheet cassette 6 one at a time. A printing sheet P delivered from the sheet cassette 6 is conveyed further by the sheet feeing mechanism section 5. After the printing sheet P is conveyed to a predetermined position, ink droplets are ejected from the printing head unit 10 toward the printing sheet P while the printing head unit 10 is moved in the main scanning direction. Each time the printing head unit 10 is moved in one direction or reciprocated once, the printing sheet P is intermittently fed in the sub-scanning direction at a predetermined pitch. Thus, an image is formed throughout the printing sheet P.

Further, an ink cartridge 20 is removably mounted in the inkjet printing apparatus 1. The ink cartridge 20 contains inks of respective colors to be supplied to the printing head unit 10. As a result of ejection of inks from the printing head unit 10, the amount of inks remaining in the sub-tanks of the printing head unit 10 decreases, and the printing head unit 10 is moved to the home position when the amount of the remaining inks becomes very small or zero. The printing head unit 10 is connected with the ink cartridge 20 in the home position, and each of the sub-tanks of the printing head unit 10 is replenished with the respective ink from the ink cartridge 20. The replenishment of inks will be detailed later.

A cover 7 for cartridge replacement is provided on a side of the bottom case 3 such that it can be opened and closed. The cartridge replacement cover 7 can be opened to replace an ink cartridge 20 which has been used up with a new one.

The ink cartridge 20 and the printing head unit 10 will now be described with the focus of discussion placed on a structure corresponding to the connection between these members.

Figure 2:
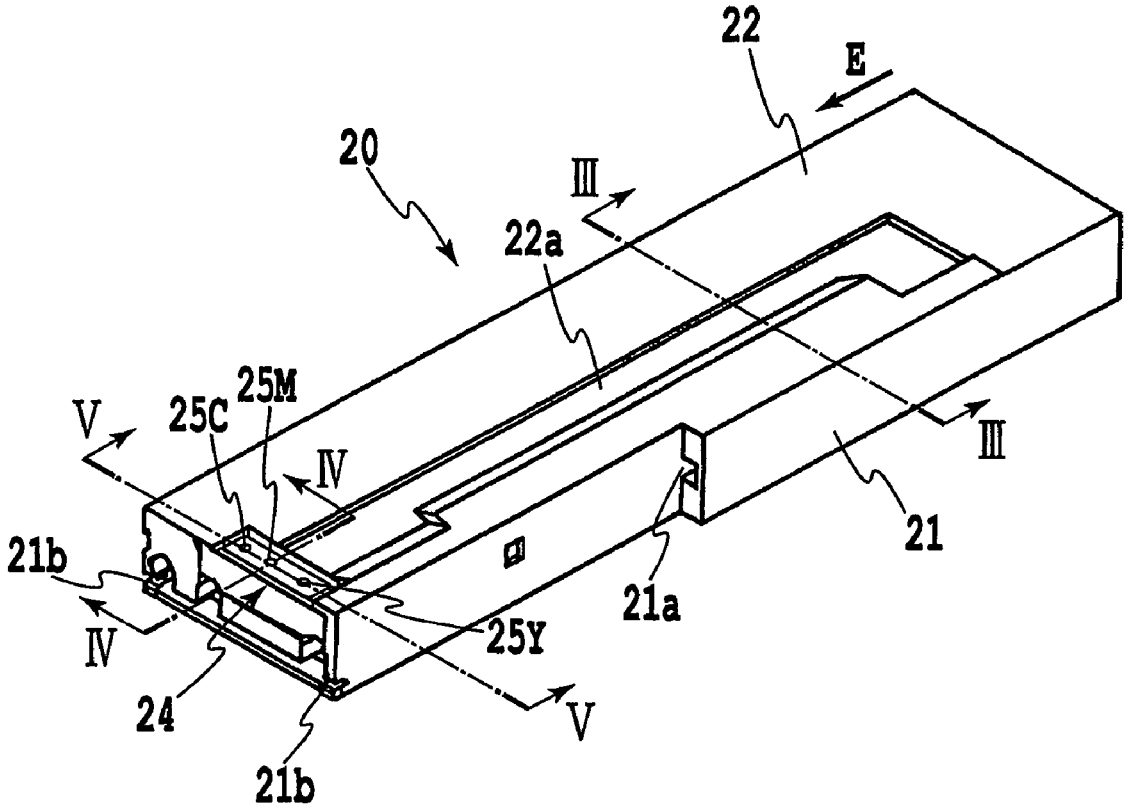
FIG. 2 is a perspective view of the ink cartridge shown in FIG. 1B.
Figure 3:
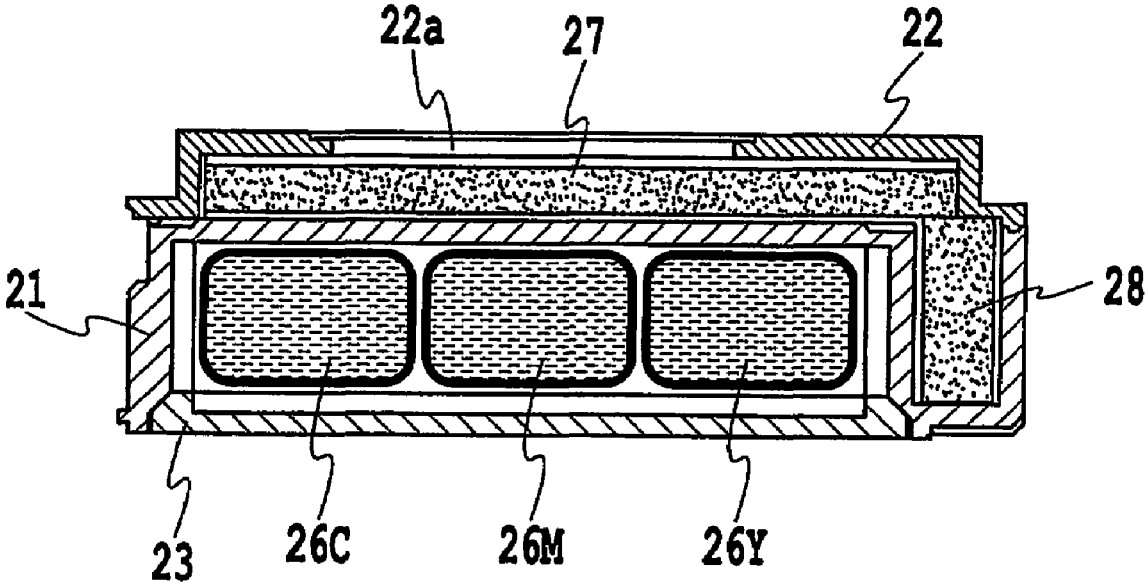
FIG. 3 is a sectional view of the ink cartridge shown in FIG. 2 taken along the line III-III.
Figure 4:
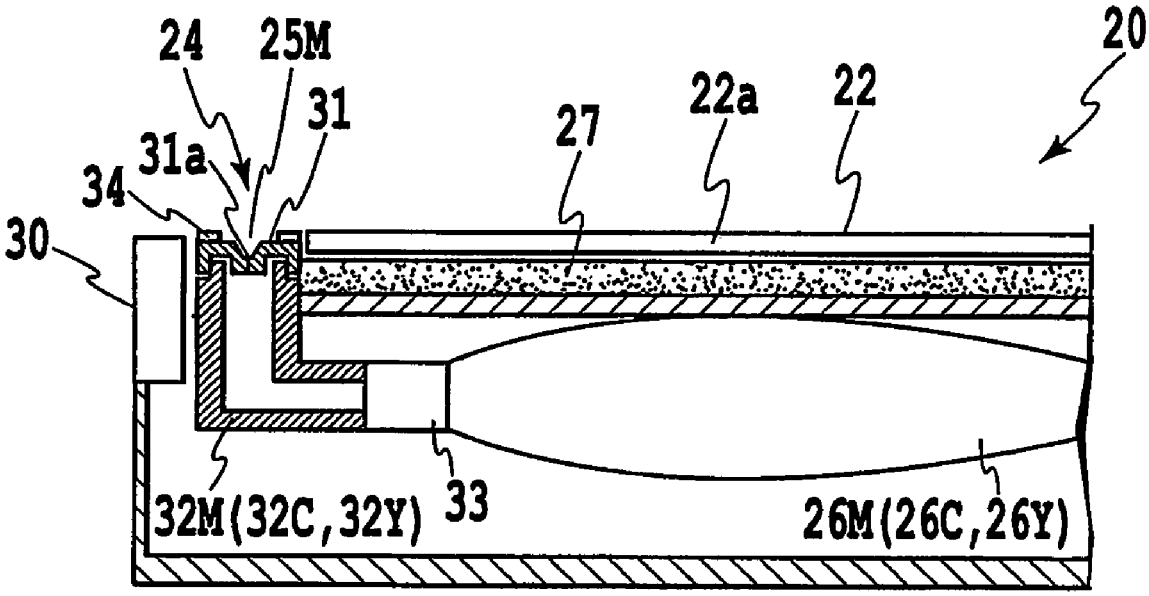
FIG. 4 is a sectional view of the ink cartridge shown in FIG. 2 taken along the line IV-IV.
Figure 5:
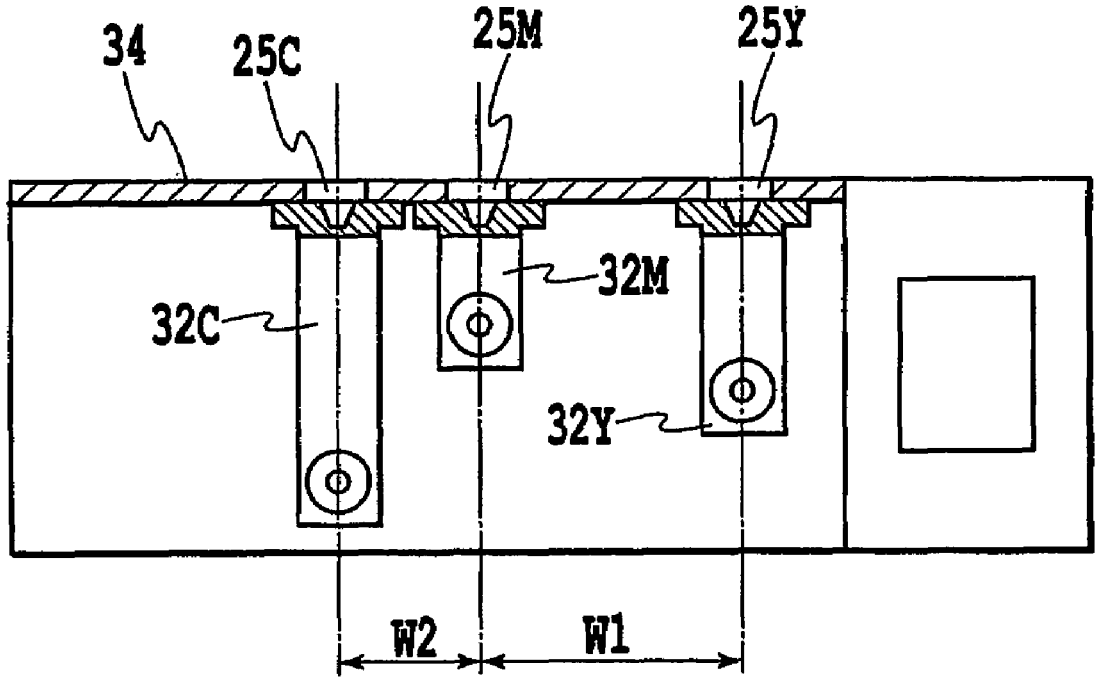
FIG. 5 is a schematic sectional view of the ink cartridge shown in FIG. 2 taken along the line V-V.

First, the ink cartridge 20 will be described. FIG. 2 is a perspective view of the ink cartridge 20 shown in FIGS. 1A and 1B. FIG. 3 is a sectional view taken along the line III-III in FIG. 2. FIG. 4 is a sectional view taken along the line IV-IV in FIG. 2. FIG. 5 is a sectional view taken along the line V-V in FIG. 2.

As shown in FIGS. 2 and 3, the outer casing of the ink cartridge 20 is constituted by a main housing 21, a lid member 22, and a bottom plate 23. Ink containing parts 26C, 26M, and 26Y for containing inks of cyan (C), magenta (M), and yellow (Y) independently of each other are accommodated in the space inside the ink cartridge 20. Further, a waste ink absorbing member 27 and a waste ink holding member 28 are accommodated in the ink cartridge 20.

Two engagement grooves 21*b* located on both sides of the ink cartridge 20 in the width direction thereof are formed in a part of the main housing 21 which is located at one end of the ink cartridge 20 in the longitudinal direction thereof. The engagement grooves 21*b* engage a lever member (not shown) provided at the inkjet printing apparatus 1 (see FIGS. 1A and 1B) when the ink cartridge 20 is mounted in the inkjet printing apparatus 1 in the direction of the arrow E. Thus, one end of the ink cartridge 20 is positioned inside the inkjet printing apparatus 1. The lever member is provided such that it can be moved up and down, and it is used also for connecting the ink cartridge 20 and the printing head unit 10 (se FIGS. 1A and 1B).

A part of the lid member 22 is cut away, and a joint section 24 for connection with the printing head unit 10 is provided in the cutaway region. When the inks are supplied to the printing head unit 10, the printing head unit 10 is kept stationary in a position where at least a part of the same faces the joint section 24. The joint section 24 is located at the longitudinal end of the ink cartridge 20. The joint section 24 includes a supplying part 25C for the cyan ink, a supplying part 25M for the magenta ink, and a supplying part 25Y for the yellow ink.

The ink containing parts 26C, 26M, and 26Y contain inks to be supplied to the printing head unit 10, and they are disposed in a space that is formed by the main housing 21 and the bottom plate 23. In the present embodiment, films formed like bags are used as the ink containing parts 26C, 26M, and 26Y such that those parts can be deformed as the inks are let out. Referring to the films that constitute the ink containing parts 26C, 26M, and 26Y, laminate films having a multi-layer structure constituted by a polyethylene terephthalate layer, an aluminum layer, and a polypropylene layer may be used from the viewpoint of ease of manufacture, required mechanical strength, and air-tightness. Those layers have a thickness of several μm to several tens μm. The capacity of the ink containing parts 26C, 26M, and 26Y may be appropriately determined according to the use of the inkjet printing apparatus 1 (see FIGS. 1A and 1B). In the present embodiment, 4 $mm^3$ of ink is contained in each of the ink containing parts 26C, 26M, and 26Y to allow printing on 50 printing sheets P which are popularly used A4 sheets.

The waste ink holding member 28 holds waste ink evacuated from the printing head unit 10 by the suction pump during the recovery operation as described above, and the member is disposed in a space formed in the main housing 21 separately from the space where the ink containing parts 26C, 26M, and 26Y are accommodated. The waste ink absorbed by the suction pump flows through a plumbing line such as a pipe which is not shown, and the ink is introduced and held in the waste ink holding member 28 through a waste ink introduction hole 21*a* formed in the main housing 21.

The waste ink absorbing member 27 is disposed in a space formed by the main housing 21 and the lid member 22. The waste ink absorbing member 27 receives and absorbs ink droplets which have been ejected from the printing head unit 10 and which have not landed on a printing sheet P when no-margin printing (also referred to as "margin-less printing") is performed on the printing sheet P, which may be plain paper or postcard, using the printing head unit 10. The lid member 22 is formed with opening 22*a* to expose the waste ink absorbing member 27. A part of the waste ink absorbing member 27 is in contact with the waste ink holding member 28, and any part of waste ink beyond the holding capacity of the waste ink holding member 28 is absorbed by the waste ink absorbing member 27. In the present embodiment, a stack of layers of an unwoven pulp fabric and an unwoven synthetic fabric having a thickness of about 3 mm is used as the waste ink absorbing member 27. The thickness of the waste ink absorbing member 27 may be appropriately set based on the amount of ink absorbed by the waste ink absorbing member 27 before the inks in the ink cartridge 20 are used up and the area of the region where the waste ink absorbing member 27 is provided. In the present embodiment, the waste ink absorbing member 27 and the waste ink holding member 28 are configured as separate members. Alternatively, the waste ink absorbing member 27 and the waste ink holding member 28 may be configured as a single member by, for example, bending an end of the waste ink absorbing member 27.

Referring to FIG. 4, connection members 32C, 32M, and 32Y are connected to the ink containing parts 26C, 26M, and 26Y, respectively through a coupling member 33. The connection members 32C, 32M, and 32Y are tubular members which are bent toward the joint section 24. An end of each of the connection members 32C, 32M, and 32Y is closed with a seal member 31, which prevents leakage of the inks from the ink cartridge 20 and evaporation of the inks when the ink cartridge 20 is not in use. The seal member 31 is formed with a slit 31*a* which extends through the member from one side to another. The seal member 31 is preferably made of a material which is resistant to the inks used and which suppresses evaporation of the inks at the sealed region. Further, the seal member 31 is preferably made of a material which allows a pipe member, which will be described later, provided at the printing head unit 10 to be inserted with a small force. In the present embodiment, chlorinated butyl rubber is used as the material of the seal member 31. For example, silicone rubber or styrene type rubber which can be elastometrically molded may be used as the material of the seal member 31.

The seal member 31 is secured at an end of each of the connection members 32C, 32M, and 32Y. The seal members 31 are collectively secured to the respective ends of the connection members 32C, 32M, and 32Y with a keep plate 34. The keep plate 34 is formed with three openings corresponding to the positions of the seal members 31 respectively, and the openings constitute the supplying parts 25C, 25M, and 25Y described above.

As shown in FIG. 4, an absorbing member 30 is provided at the ink cartridge 20. The absorbing member 30 is set in apposition where it contacts the wiping member of the above-described recovery mechanism when the ink cartridge 20 is mounted in the inkjet printing apparatus (see FIGS. 1A and 1B). As a result, the absorbing member 30 can absorb any foreign substance deposited on the wiping member after a wiping operation. The wiping member is preferably made of a material which can absorb and hold an ink, which is resistant to the inks used, and which remains stable in strength and chemical characteristics even after contact with the wiping member for a long time. In the present embodiment, a polyethylene porous member having a thickness of 1.2 mm is used as the absorbing member 30. For example, a polypropylene or polyurethane type fiber may alternatively be used as the absorbing member 30.

As shown in FIG. 5, the supplying parts 25C, 25M, and 25Y are disposed on the same plane and are aligned in a row on the same straight line in the order listed. W1 represents the interval between the yellow ink supplying part 25Y and the magenta ink supplying part 25M adjacent thereto. W2 represents the interval between the supplying parts excluding the yellow ink supplying part 25Y, i.e., the interval between the cyan ink supplying part 25C and the magenta ink supplying part 25M adjacent thereto. The interval W1 is greater than the interval W2.

Figure 6:
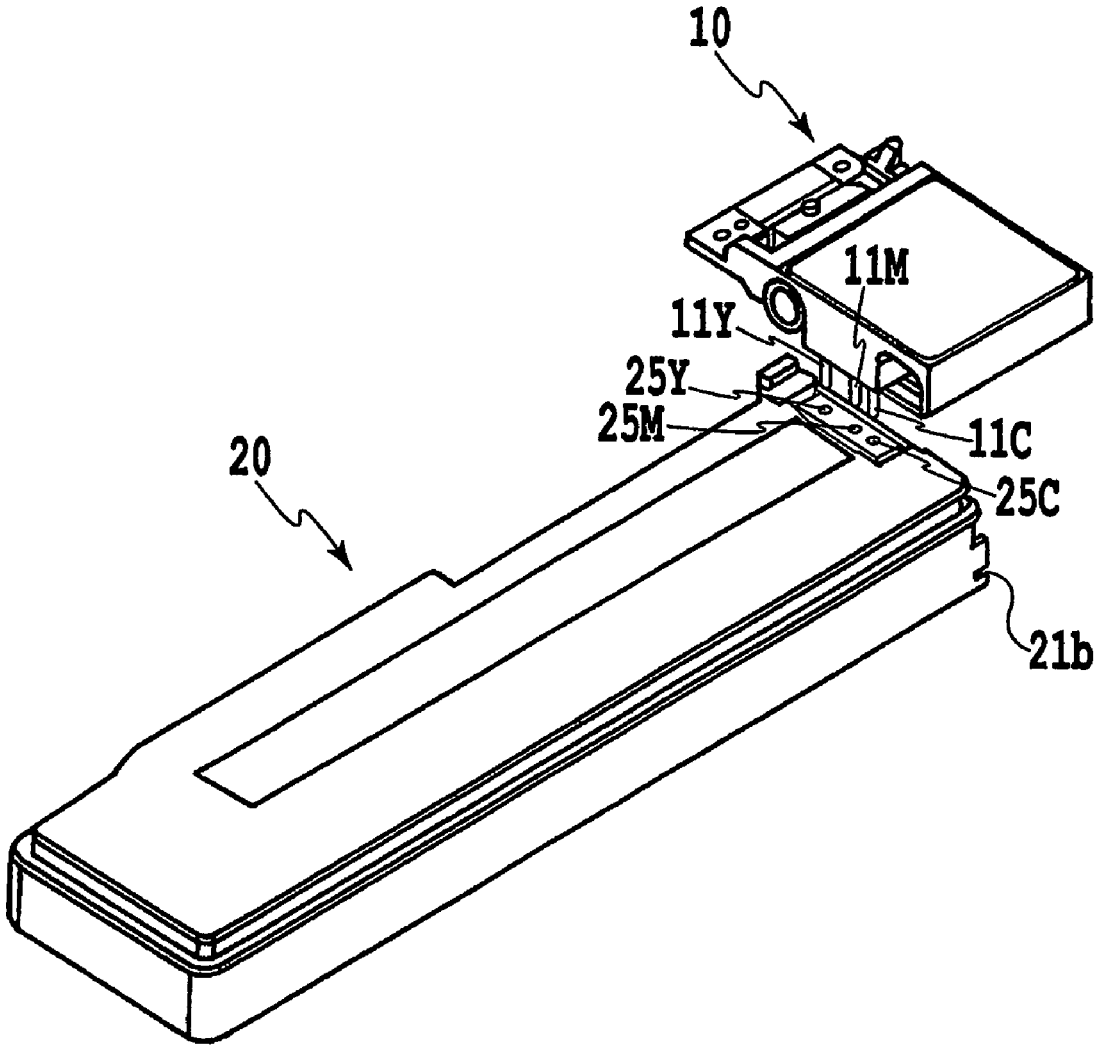
FIG. 6 is a perspective view for explaining a relationship between the ink cartridge and the printing head unit shown in FIG. 1B.

The printing head unit 10 will now be described with reference to FIG. 6.

As described above, the printing head unit 10 has ink ejecting parts and sub-tanks corresponding to inks of cyan, magenta, and yellow, respectively. As a section for connection with the ink cartridge 20, the three pipe members 11C, 11M, and 11Y constituting receiving parts are provided such that they protrude from the printing head unit 10. The pipe members 11C, 11M, and 11Y are corresponding to the inks of the respective colors. Specifically, the pipe member 11C for the cyan ink is connected to the sub-tank for the cyan ink; the pipe member 11M for the magenta ink is connected to the sub-tank for the magenta ink; and the pipe member 11Y for the yellow ink is connected to the sub-tank for the yellow ink. That is, the pipe members 11C, 11M, and 11Y are provided at the ink ejecting parts corresponding to the respective ink colors and are connected to the ink ejecting parts for the respective ink colors through the sub-tanks.

When the printing head unit 10 receives the inks from the ink cartridge 20 or when the printing head unit 10 is in the position for connection with the ink cartridge, the pipe members 11C, 11M, and 11Y face the respective supplying parts 25C, 25M, and 25Y of the ink cartridge 20. The pipe members 11C, 11M, and 11Y are provided such that they extend toward the respective supplying parts 25C, 25M, and 25Y.

In the present embodiment, the pipe members 11C, 11M, and 11Y are disposed on the side of the printing head unit 10 facing the ink cartridge 20 such that they are aligned in a row on the same straight line in the order listed. The intervals between adjoining pairs among the pipe members 11C, 11M, and 11Y are set equal to the intervals between respective adjoining pairs among the supplying parts 25C, 25M, and 25Y of the ink cartridge 20. Specifically, the interval (center distance) between the pipe member 11Y for the yellow ink and the pipe member 11M for the magenta ink adjacent to the same is represented by W1 (see FIG. 5). The interval (center distance) between the pipe member 11C for the cyan ink and the pipe member 11M for the magenta ink adjacent to the same is represented by W2 (see FIG. 5).

During a printing operation, the printing head unit 10 moves back and forth in the main scanning direction in a position above the ink cartridge 20. The printing sheet P (see FIG. 1B) is conveyed in the sub-scanning direction between the printing head unit 10 and the ink cartridge 20. In a region which is opposite to the printing head unit 10 during the printing operation, a platen which is not shown for supporting the printing sheet P is provided. The platen is located above the ink cartridge 20.

As the printing operation proceeds, the inks in the sub-tanks of the printing head unit 10 are consumed. The amount of the inks remaining in the sub-tanks is detected using an appropriate method. The amount of the remaining inks may be detected using a well-known method such as a method utilizing conductivity of the ink or a method in which the amount is indirectly detected from the number of ink droplets (which is a number corresponding to the number of ink dots formed) ejected from the ink ejecting parts. When it is determined that the amount of the inks remaining in the sub-tanks has become very small or zero based on the result of detection using such a detection method, the printing head unit 10 is moved to the home position.

Thereafter, the above-described lever member that is engaged with the engagement grooves 21*b* of the ink cartridge 20 is elevated, and the end of the ink cartridge 20 where the engagement grooves 21*b* are provided is consequently elevated toward the printing head unit 10. Accordingly, the pipe members 11C, 11M, and 11Y are inserted from the respective supplying parts 25C, 25M, and 25Y into the respective connection members 32C, 32M, and 32Y through the slits 31*a* (see FIG. 4) of the respective seal members 31. As a result, the printing head unit 10 and the ink cartridge 20 are connected, and ink supply paths are thus formed through the hollow parts of the pipe members 11C, 11M, and 11Y.

After the printing head unit 10 and the ink cartridge 20 are thus connected, the inks are supplied from the ink cartridge 20 to the printing head unit 10. The inks are supplied using any method and, for example, they may be supplied using the head recovery mechanism described above. Specifically, the ink ejecting parts of the printing head unit 10 are capped by the cap, and the suction pump can be driven in this state to supply the inks. The cap and the suction pump may be provided at each of the ink ejecting parts, in which case the ink in each color can be supplied independently of each other.

When the supply of the inks from the ink cartridge 20 to the printing head unit 10 is completed, the lever member is lowered. Accordingly, the end of the ink cartridge 20 is lowered, and the pipe members 11C, 11M, and 11Y are removed from the slits 31*a* of the respective seal members 31 to disconnect the printing head unit 10 and the ink cartridge 20. After the pipe members 11C, 11M, and 11Y are removed, the slits 31*a* of the seal members 31 are closed due to the elasticity of the members. Therefore, neither leakage nor evaporation of the inks from the ink cartridge 20 occurs. After the printing head unit 10 and the ink cartridge 20 are disconnected as thus described, the inkjet printing apparatus 1 (see FIGS. 1A and 1B) continues the printing operation or performs the series of ink supplying operations as occasion demands.

When any surplus of the inks remain and spread in the neighborhood of the supplying parts 25C, 25M, and 25Y as a result of repetition of the connection and disconnection of the printing head unit 10 and the ink cartridge 20, the residual inks of different colors can mix with each other to cause color mixing. In order to prevent the occurrence of such color mixing, greater intervals may be set between the supplying parts 25C, 25M, and 25Y. In this case, however, the size of the joint section 24 (see FIG. 1B) increases, and the size of the printing head unit 10 also increases accordingly, which consequently hinders the reduction of the size of the inkjet printing apparatus 1 as a whole.

Under the circumstance, the present embodiment focuses on the ink which is most vulnerable to color mixing among the plural types of inks used, i.e., the yellow ink which is subjected to the most significant color change attributable to color mixing. The yellow ink supplying part 25Y is disposed apart from the supplying parts for the other inks (the supplying parts 25C and 25M for the cyan and magenta inks, respectively). That is, the interval between the yellow ink supplying part 25Y and the supplying part for another ink adjacent to the same is greater than the interval between the supplying parts for the other inks. Specifically, as described above, the interval W1 between the yellow ink supplying part 25Y and the magenta ink supplying part 25M that are adjacent to each other is greater than the interval W2 between the magenta ink supplying part 25M and the cyan ink supplying part 25C that are adjacent to each other.

As thus described, the interval between the yellow ink supplying part 25Y and the supplying part for another ink adjacent to the same is made greater instead of providing uniformly increased intervals between all adjoining pairs of the supplying parts. It is therefore possible to reduce the risk of occurrence of color mixing for the yellow ink that is vulnerable to color mixing. As a result, the size of the connecting section between the printing head unit 10 and the ink cartridge 20 can be minimized while reducing the possibility of degradation of image quality attributable to color mixing. That is, images of high quality can be printed by reducing the rate of occurrence of color mixing at the yellow ink while preventing any increase in the size of the printing head unit 10, the ink cartridge 20, and the inkjet printing apparatus 1 (see FIGS. 1A and 1B) as a whole consequently.

When connection and disconnection is repeated between the ink cartridge 20 and the printing head unit 10 as seen in the case of the pit-in supply method according to the present embodiment, high quality images in stable colors having substantially no change in color can be printed until the ink cartridge 20 is used up while achieving a reduction in the size of those components.

The supplying parts 25C, 25M, and 25Y in the present embodiment are formed as openings in the keep plate 34 (see FIG. 5). Thus, the supplying parts 25C, 25M, and 25Y can be formed on the same plane, which improves the positional accuracy of the supplying parts 25C, 25M, and 25Y. As a result, the operation of connecting the ink cartridge 20 and the printing head unit 10 can be performed at high accuracy to prevent the occurrence of ink leakage when they are connected and disconnected. Further, the formation of the supplying parts 25C, 25M, and 25Y on the same plane, and there is not need for forming supplying parts for respective ink colors on different planes, which allows a further size reduction.

Figure 7:
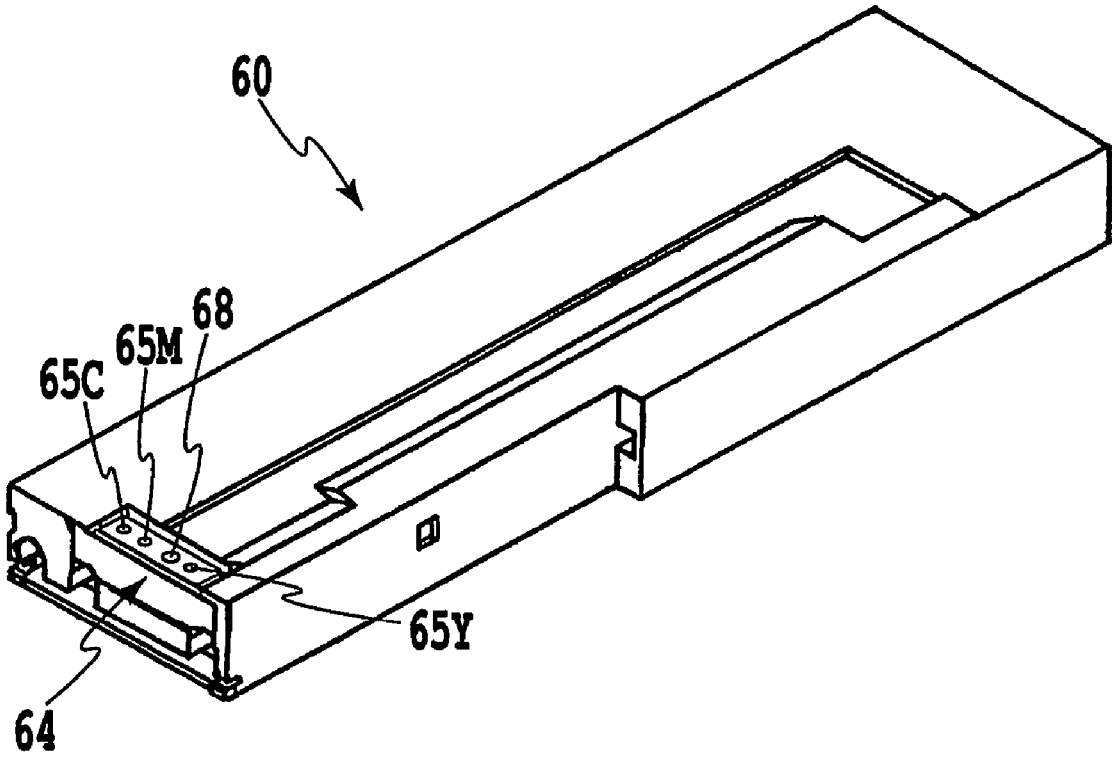
FIG. 7 is a perspective view of an ink cartridge in another embodiment of the present invention.
Figure 8:
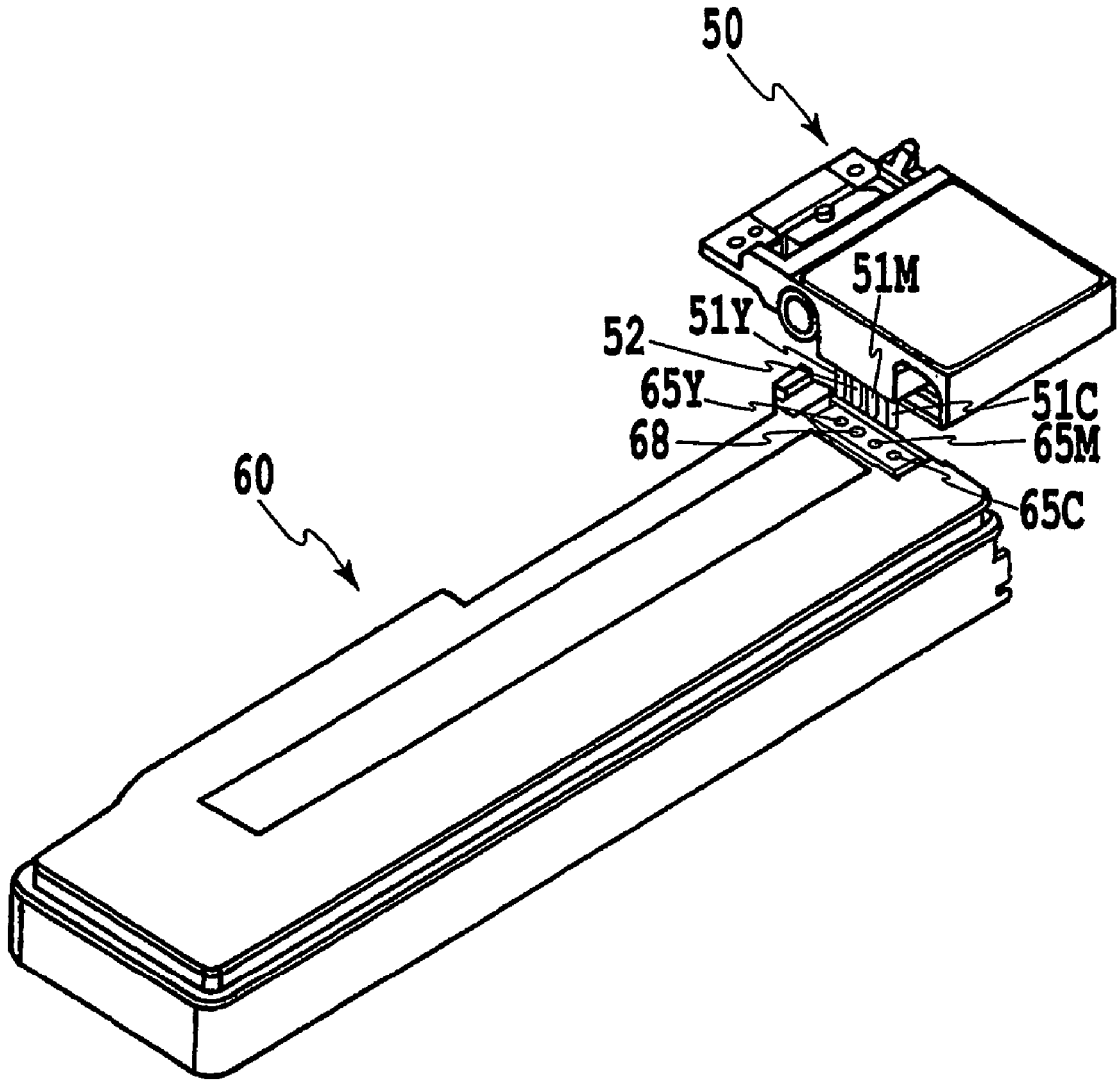
FIG. 8 is a perspective view for explaining a relationship between the ink cartridge shown in FIG. 7 and a printing head unit.
Figure 9A:
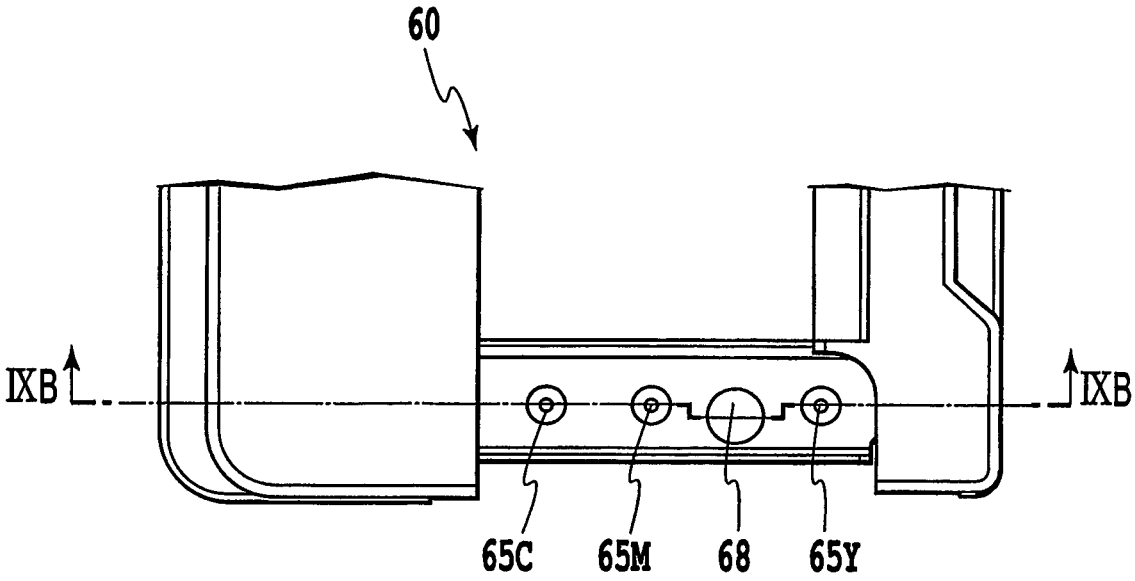
FIG. 9A is an enlarged plan view of a joint section of the ink cartridge shown in FIG. 7.
Figure 9B:
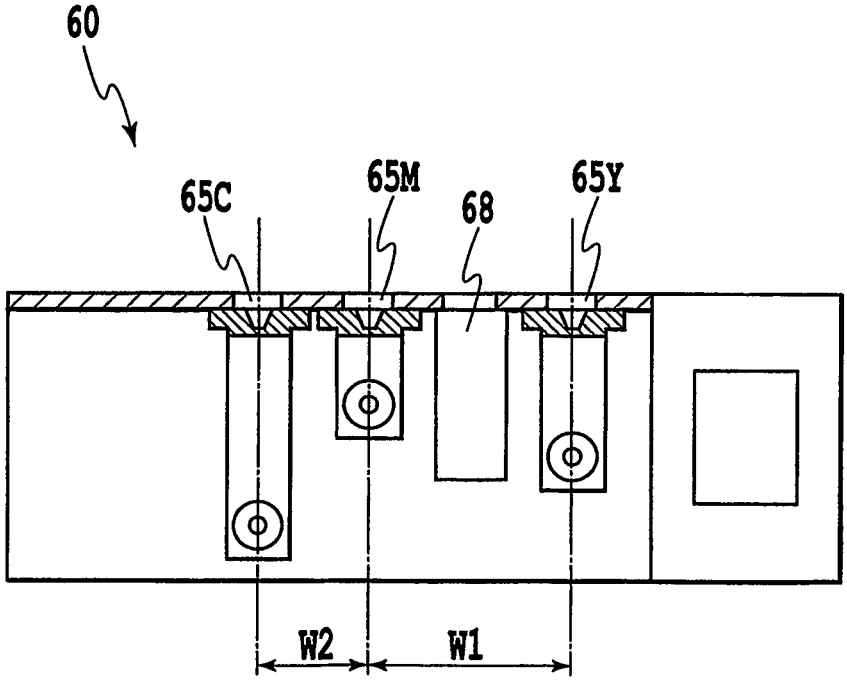
FIG. 9B is a schematic sectional view of the joint section shown in FIG. 9A taken along the line IXB-IXB.

FIG. 7 is a perspective view of an ink cartridge in another embodiment of the present invention. FIG. 8 is a perspective view for explaining a positional relationship between the ink cartridge shown in FIG. 7 and a printing head unit. FIGS. 9A and 9B are plan view and a sectional view, respectively, of a joint section of the ink cartridge shown in FIG. 7.

An ink cartridge 60 of the present embodiment is basically similar to the ink cartridge 20 of the above embodiment in configuration. Specifically, the ink cartridge 60 contains inks of three colors, i.e., cyan, magenta, and yellow inks, and the cartridge has a supplying part 65C for the cyan ink, a supplying part 65M for the magenta ink, and a supplying part 65Y for the yellow ink as a joint section 24 with a printing head 50. In FIG. 9B, W1 represents the interval between the yellow ink supplying part 65Y and the magenta ink supplying part 65M, and W2 represents the interval between the magenta ink supplying part 65M and the cyan ink supplying part 65C. The interval W1 is greater than the interval W2.

A printing head unit 50 is basically similar to the printing head unit 10 in the above embodiment in configuration. Specifically, the printing head unit 50 has a pipe member 51C for the cyan ink, a pipe member 51M for the magenta ink, and a pipe member 51Y for the yellow ink as receiving parts for receiving the supply of the inks in the respective colors from the ink cartridge 60. The intervals between the pipe members 51C, 51M, and 51Y are set similarly to the intervals between the supplying parts 65C, 65M, and 65Y of the ink cartridge 60.

The present embodiment includes features for positioning the ink cartridge 60 and the printing head unit 50 when they are connected. The description will omit other features of the embodiment which are similar to those in the above-described embodiment and which provide similar effects.

The features for positioning the ink cartridge 60 and the printing head unit 50 will now be described.

The ink cartridge 60 is formed with a reference hole 68 to be used for positioning when the cartridge is connected with the printing head unit 50. The reference hole 68 is located at a joint section 64 and is on the same plane as supplying parts 65C, 65M, and 65Y. As described above, a yellow ink is most vulnerable to color changes attributable to color mixing among cyan, magenta, and yellow inks. The reference hole 68 is formed between the supplying part 65Y for the yellow ink and the supplying part 65M for the magenta ink adjacent to the same.

The printing head unit 50 is formed with a reference pin 52 for positioning in a position opposite to the reference hole 68. Specifically, the reference pin 52 is provided between the pipe member 51Y for the yellow ink and the pipe member 51M for the magenta ink. The reference pin 52 is provided such that it protrudes similarly to the pipe members 51C, 51M, and 51Y. The reference pin 52 is opposite to the reference hole 68 of the ink cartridge 60 when the printing head unit 50 is in a position for receiving supply of inks from the ink cartridge 60. The reference pin 52 is formed in such dimensions that it can be inserted into the reference hole 68. The protruding length of the pin 52 above the printing head unit 50 is greater than that of the pipe members 51C, 51M, and 51Y.

When the ink cartridge 60 and the printing head unit 50 are connected, the joint section 64 of the ink cartridge 60 and receiving parts of the printing head unit 50 (pipe members 51C, 51M, and 51Y) approach each other. The reference pin 52 is first inserted into the reference hole 68, and the pipe members 51C, 51M, and 51Y are thereafter inserted into the supplying parts 65C, 65M, and 65Y. As thus described, the reference pin 52 is inserted into the reference hole 68 prior to the insertion of the pipe members 51C, 51M, and 51Y into the supplying parts 65C, 65M, and 65Y. As a result, the ink cartridge 60 and the printing head unit 50 are positioned with high accuracy when they are connected.

The structures for positioning (the reference pin 52 and the reference hole 68) are disposed between the connecting structures corresponding to the yellow ink (the pipe member 51Y and the supplying part 65Y) and the connecting structures corresponding to the magenta ink (the pipe member 51M and the supplying part 65M). Thus, the accuracy of connection between the ink cartridge 60 and the printing head unit 50 is further improved. Specifically, when there is a misalignment between the ink cartridge 60 and the printing head unit 50 in the direction of a rotation about the axis of the reference pin 52 and the reference hole 68, the amount of the misalignment between the connecting structures is kept small. Let us now assume that the structures for positioning (the reference pin 52 and the reference hole 68) are provided in a position apart from the joint section 64 and the receiving parts (pipe members 51C, 51M, and 51Y). In this case, when there is a misalignment between the ink cartridge 60 and the printing head unit 50 in the direction of a rotation about the axis of the reference pin 52 and the reference hole 68, a greater misalignment occurs between the connecting structures.

As thus described, the amount of a misalignment between the connecting structures of the ink cartridge 60 and the printing head unit 50 can be kept small to improve the accuracy of connection between those components by providing the positioning structures (the reference pin 52 and the reference hole 68) at the joint section 64 and the receiving parts (the pipe members 51C, 51M, and 51Y). Further, the positioning structures can be provided in combination with the joint section 64 and the receiving parts (the pipe members 51C, 51M, and 51Y) for high spatial efficiency. By providing such positioning structures, any increase in the size of the ink cartridge 60, the printing head unit 50, and the inkjet printing apparatus can be prevented.

Even if a surplus of the inks remains and spreads in the neighborhood of the magenta ink supplying part 65M as a result of repetition of the connection and disconnection of the ink cartridge 60 and the printing head unit 50, the residual inks enter the reference hole 68 to be held therein before reaching the yellow ink supplying part 65Y. As a result, the occurrence of color mixing at the yellow ink can be further suppressed. In the present embodiment, since the reference hole 68 is provided on the same plane as the supplying parts 65C, 65M, and 65Y, the residual inks will not be prevented from entering the reference hole 68.

Typical embodiments of the present invention have been described above by way of example. However, the present invention is not limited to those embodiments and may be modified as occasions demand within the scope of the technical teachings of the present invention.

In the above embodiments, supplying parts for inks of three colors, i.e., cyan, magenta, and yellow are arranged in a row at an ink cartridge. However, the types and the number of inks to be used are not limited to that described above, and the supplying parts are not required to be arranged in a row. Several examples of modifications will now be described with reference to FIGS. 10A, 10B, and 10C.

Figure 10A:
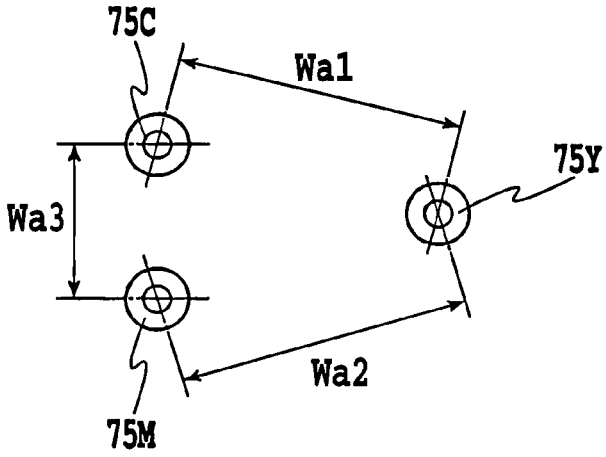
FIGS. 10A, 10B, and 10C are plan views of a supply section of an ink cartridge showing examples of different dispositions of the same.

FIG. 10A shows an example of an ink cartridge containing inks of three colors similarly to those in the above embodiments. The ink cartridge has a supplying part 75C for a cyan ink, a supplying part 75M for a magenta ink, and a supplying part 75Y for a yellow ink. The supplying parts 75C, 75M, and 75Y are disposed two-dimensionally instead of being disposed on the same straight line. The yellow ink supplying part 75Y is adjacent to the cyan ink supplying part 75C and the magenta ink supplying part 75M. Wa1 represents the interval between the yellow ink supplying part 75Y and the cyan ink supplying part 75C. Wa2 represents the interval between the yellow ink supplying part 75Y and the magenta ink supplying part 75M. Wa3 represents the interval between the cyan ink supplying part 75C and the magenta ink supplying part 75M. In such an arrangement of the supplying parts 75C, 75M, and 75Y, the intervals Wa1 and Wa2 are made greater than the interval Wa3.

Such a setting of the intervals Wa1, Wa2, and Wa3 makes it possible to prevent color mixing at the yellow ink efficiently in the same way as in the above embodiments. The interval Wa1 between the yellow ink supplying part 75Y and the cyan ink supplying part 75C and the interval Wa2 between the yellow ink supplying part 75Y and the magenta ink supplying part 75M are only required to be intervals which allow color mixing at the yellow ink to be efficiently prevented, and those intervals may be different from each other.

Figure 10B:
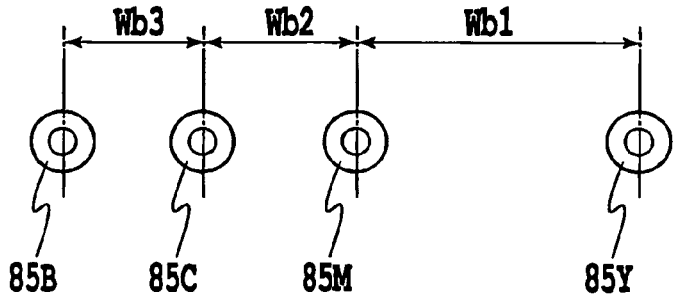

FIG. 10B shows an example of an ink cartridge containing inks of four colors in total which are inks of three colors, i.e., cyan, magenta, and yellow plus a black ink. Supplying parts including a black ink supplying part 85B, i.e., supplying parts 85B, 85C, 85M, and 85Y are disposed on the same straight line. The yellow ink supplying part 85Y is located at an end of the arrangement of the supplying parts 85B, 85C, 85M, and 85Y and is adjacent to only the magenta ink supplying part 85M. Wb1 represents the interval between the yellow ink supplying part 85Y and the magenta ink supplying part 85M. Wb2 represents the interval between the magenta ink supplying part 85M and the cyan ink supplying part 85C. Wb3 represents the interval between the cyan ink supplying part 85C and the black ink supplying part 85B. In such an arrangement of the supplying parts 85B, 85C, 85M, and 85Y, the interval Wb1 is greater than the intervals Wb2 and Wb3. Thus, color mixing at the yellow ink can be effectively prevented.

Figure 10C:
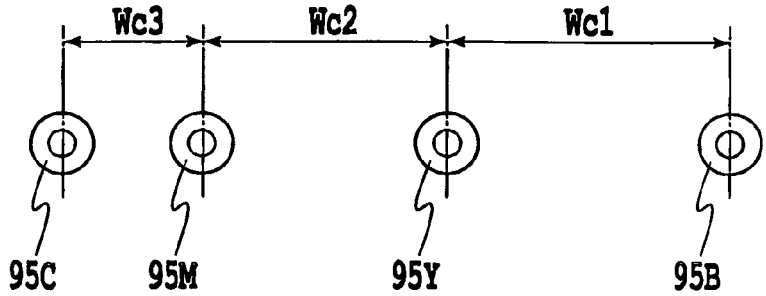
Figure 11:
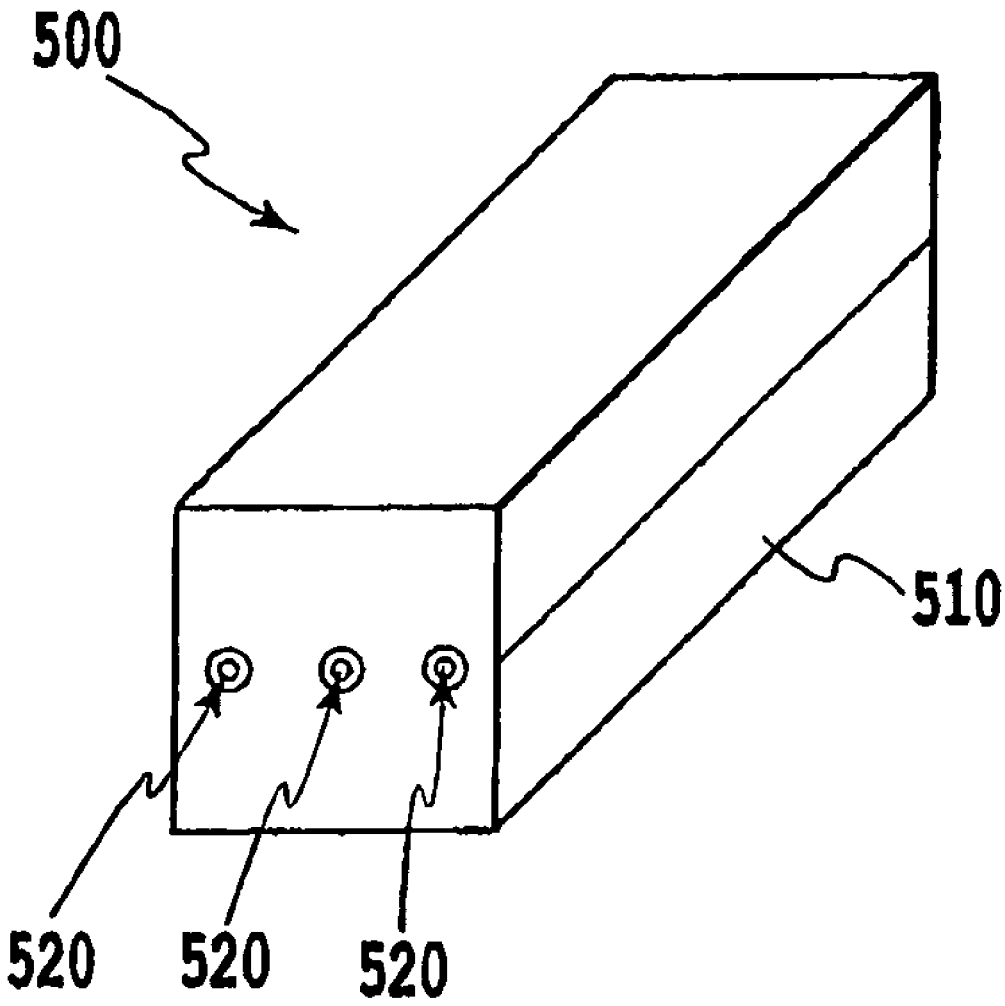
FIG.11 (PRIOR ART)
FIG. 11 is a perspective view of an ink cartridge according to the related art.
Figure 12:
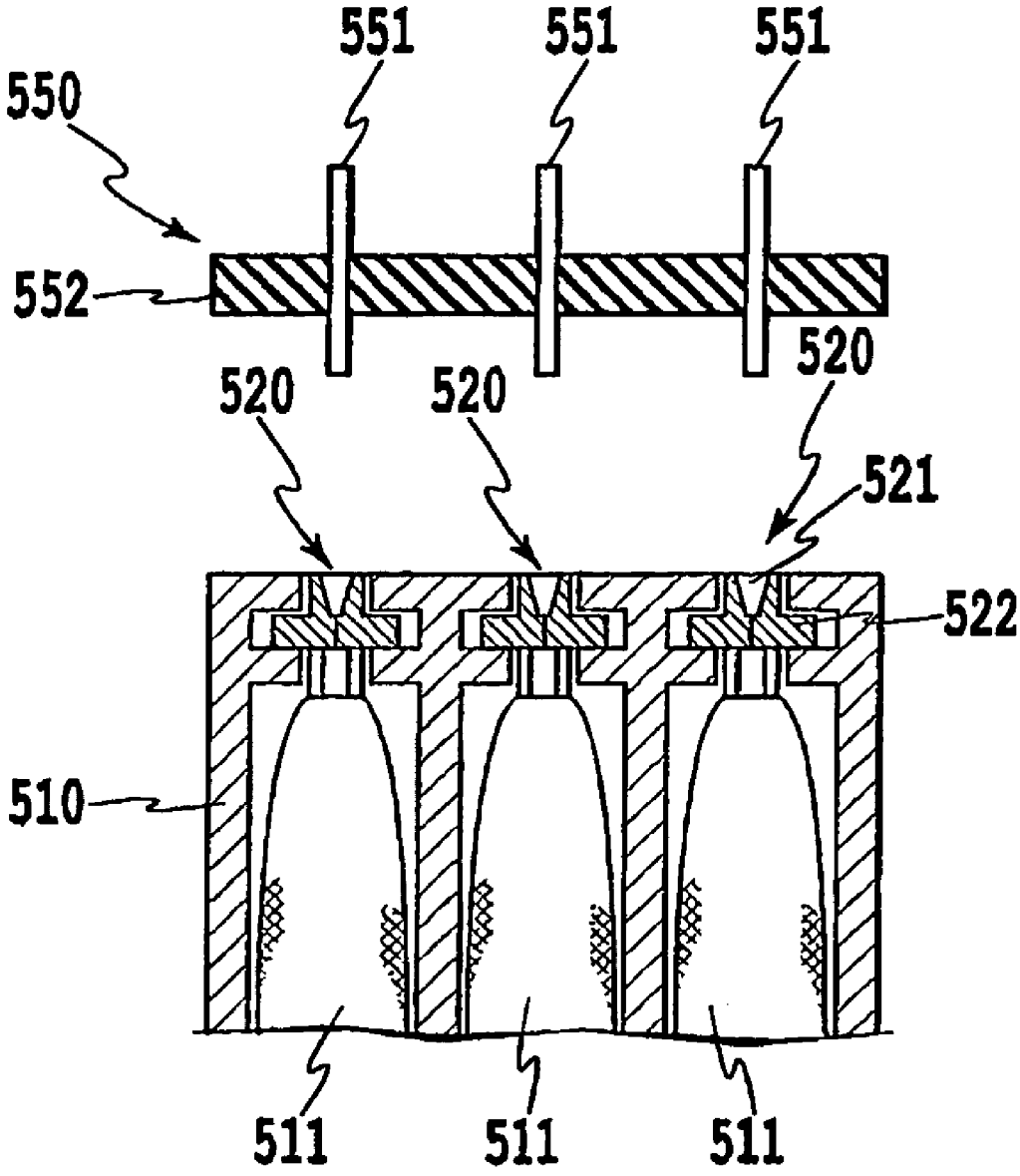
FIG.12 (PRIOR ART)
FIG. 12 is a sectional view for explaining a relationship between the ink cartridge shown in FIG. 11 and a printing head.

FIG. 10C shows an example of an ink cartridge containing inks of four colors similar to the example in FIG. 10B. Supplying parts 95C, 95M, 95Y, and 95B are disposed on the same straight line. However, the supplying parts 95C, 95M, 95Y, and 95B are arranged in an order different from that in the example in FIG. 10B. The cyan ink supplying part 95C and the black ink supplying part 95B are located on both sides of the arrangement, and the yellow ink supplying part 95Y is adjacent to the magenta ink supplying part 95M and the black ink supplying part 95B. Wc1 represents the interval between the yellow ink supplying part 95Y and the black ink supplying part 95B. Wc2 represents the interval between the yellow ink supplying part 95Y and the magenta ink supplying part 95M. Wc3 represents the interval between the cyan ink supplying part 95C and the magenta ink supplying part 95M. In such an arrangement, the intervals Wc1 and Wc2 are made greater than the interval Wc3. Thus, color mixing at the yellow ink can be effectively prevented.

FIGS. 10A, 10B, and 10C merely show some of possible modifications. For example, an ink cartridge may contain inks of four colors or five or more colors, and the number of supplying parts corresponding to the same may be four or five or more. Let us assume that supplying parts for the ink of the color which undergoes the most significant color change attributable to color mixing are referred to as "specific supplying parts" and that supplying parts for inks of other colors are referred to as "other supplying parts". In this case, what is required for an arrangement of those supplying parts is as follows. The interval between a "specific supplying part" and another supplying part (which may be another "specific supplying part" or one of the "other supplying parts") adjacent to the same is only required to be greater than intervals between the "other supplying parts" that are adjacent to each other.

Further, a reference hole similar to those shown in FIGS. 9A and 9B may be provided. In this case, the reference hole is provided between a supplying part for the ink of the color which undergoes the most significant color change attributable to color mixing and another supplying part adjacent to the same.

Receiving parts (pipe members) at a printing head unit are arranged similarly to such supplying parts of the ink cartridge. That is, the receiving parts are disposed such that they face the respective supplying parts of the ink cartridge. Specifically, let us assume that receiving parts for the ink of the color which undergoes the most significant color change attributable to color mixing are referred to as "specific receiving parts" and that receiving parts for inks of other colors are referred to as "other receiving parts". Then, those receiving parts are arranged as follows. The interval between a "specific receiving part" and another receiving part (which may be another "specific receiving part" or one of the "other receiving parts") adjacent to the same is made greater than intervals between the "other receiving parts" that are adjacent to each other.

A structure for positioning (reference pin) is provided between a receiving part for the ink of the color which undergoes the most significant color change attributable to color mixing and another receiving part adjacent to the same.

In the above-described embodiments, the ink container connected to the printing head unit to supply inks to the same is a replaceable cartridge. However, it is not essential that the ink container is in the form of a cartridge, and what is required for the container is to have a configuration which allows replenishment of inks as occasions demand. For example, the ink container may be unremovably provided in an inkjet printing apparatus.

The present invention may be applied to any configuration in which an ink container can be connected and disconnected to and from an ink supply path of a printing head and may be applied to ink supply methods other than the pit-in supply method. When the present invention is applied to an ink supply method other than the pit-in supply method, a printing head does not necessarily include sub-tanks. In this case, receiving parts of the printing head are connected to respective ink ejecting parts through ink channels for respective ink colors.

An ink supply path to and from which an ink container can be connected and disconnected may be formed in a region other than a printing head. That is, the ink supply path may be formed in various members other than the printing head.

The present invention has been described in detail with respect to preferred embodiments, and it will now be apparent from the foregoing to those skilled in the art that changes and modifications may be made without departing from the invention, therefore, in the apparent claims to cover all such changes.

This application claims priority from Japanese Patent Application No. 2004-123119 filed Apr. 19, 2004, which is hereby incorporated by reference herein.

The invention claimed is:

1. An ink container connectable and disconnectable to and from an ink supply path, comprising:

a plurality of ink containing parts for containing three or more different inks; and a plurality of supplying parts which can be connected and disconnected to and from the ink supply path and which can supply plural types of ink contained in the plurality of ink containing parts, wherein the plurality of supplying parts include a specific supplying part for supplying the ink which undergoes the most significant color change attributable to color mixing of the inks;

the plurality of supplying parts are disposed at respective intervals;

the interval between the specific supplying part and another of the supplying parts most closely adjacent thereto is greater than the intervals between other supplying parts excluding the specific supplying part;

the inks contained in the plurality of ink containing parts include a yellow ink, a cyan ink, and a magenta ink; and the ink which undergoes the most significant color change attributable to color mixing of the inks is the yellow ink.

2. An ink container according to claim 1, wherein the plurality of supplying parts can be connected and disconnected to and from a plurality of receiving parts in the ink supply path.

3. An ink container according to claim 1, wherein the plurality of supplying parts are disposed on the same plane.

4. An ink container according to claim 1, further comprising a connecting section connectable and disconnectable to and from an ink supply path forming member in which the ink supply path is formed, wherein the plurality of supplying parts are disposed at the connecting section.

5. An ink container according to claim 4; wherein the connecting section includes a tubular connecting member in communication with the ink containing part, a seal member for sealing an end of the connecting member, and a keep plate for securing the seal member at the end of the connecting member; and the supplying part is located in an opening formed in the keep plate.

6. An ink container according to claim 4, wherein the ink supply path forming member is a constituent member of an inkjet printing head.

7. An ink container according to claim 1, further comprising positioning means which positions the ink container relative to the ink supply path forming member in which the ink supply path is formed.

8. An ink container according to claim 7, wherein the positioning means is located between the specific supplying part and another of the supplying parts adjacent thereto.

9. An ink container according to claim 7, wherein the positioning means includes a hole which can be engaged with a protrusion provided on the ink supply path forming member.

* * * * *